US007077724B1

(12) United States Patent
Voges

(10) Patent No.: US 7,077,724 B1
(45) Date of Patent: Jul. 18, 2006

(54) SHEET METAL SCALE REMOVING WATER JET PROCESS

(75) Inventor: Kevin C. Voges, Red Bud, IL (US)

(73) Assignee: The Material Works, Ltd., Red Bud, IL (US)

( * ) Notice: Subject to any disclaimer, the term of this patent is extended or adjusted under 35 U.S.C. 154(b) by 0 days.

(21) Appl. No.: 11/145,643

(22) Filed: Jun. 6, 2005

(51) Int. Cl.
*B24B 1/00* (2006.01)

(52) U.S. Cl. ..... 451/38; 451/54; 451/81; 451/907; 72/39; 72/43; 134/15; 134/64 R; 134/198

(58) Field of Classification Search ..... 451/38, 451/39, 54, 55, 75, 81, 907; 72/39, 201, 72/43; 29/81.01, 81.06; 134/9, 15, 64 R, 134/95.3, 198
See application file for complete search history.

(56) References Cited

U.S. PATENT DOCUMENTS

| | | | | |
|---|---|---|---|---|
| 1,829,599 | A * | 10/1931 | McCrery | 451/81 |
| 3,345,841 | A | 10/1967 | Phelan et al. | |
| 4,195,450 | A * | 4/1980 | Korb et al. | 451/38 |
| 4,269,052 | A * | 5/1981 | Imai et al. | 72/39 |
| 4,513,597 | A * | 4/1985 | Kimoto et al. | 72/53 |
| 4,558,578 | A | 12/1985 | Noe et al. | |
| 4,617,815 | A | 10/1986 | Greenberger | |
| 4,787,178 | A * | 11/1988 | Morgan et al. | 451/81 |
| 4,918,959 | A | 4/1990 | Parazak et al. | |
| 4,999,956 | A * | 3/1991 | Watts | 451/83 |
| 5,235,840 | A | 8/1993 | Blazevic | |
| 5,386,668 | A * | 2/1995 | Mugge et al. | 451/91 |
| 5,533,922 | A * | 7/1996 | Yamaharu | 451/38 |
| 5,884,643 | A | 3/1999 | Shimizu et al. | |
| 5,996,200 | A | 12/1999 | Rosenthal et al. | |
| 6,134,933 | A | 10/2000 | Yamamoto et al. | |
| 6,257,034 | B1 | 7/2001 | Fukumori et al. | |
| 6,295,852 | B1 | 10/2001 | Kipping et al. | |
| 6,854,169 | B1 * | 2/2005 | Love et al. | 29/81.06 |
| 2004/0069034 | A1 | 4/2004 | Seidel | |

FOREIGN PATENT DOCUMENTS

| | | |
|---|---|---|
| DE | 4017361 | * 12/1990 |
| JP | 06055432 | * 3/1994 |

* cited by examiner

*Primary Examiner*—Eileen P. Morgan
(74) *Attorney, Agent, or Firm*—Thompson Coburn LLP

(57) ABSTRACT

An apparatus and method of removing scale from the surfaces of processed sheet metal employs high pressure jets of water directed from nozzles positioned in close proximity to the sheet metal surfaces.

26 Claims, 1 Drawing Sheet

SHEET METAL SCALE REMOVING WATER JET PROCESS

BACKGROUND OF THE INVENTION (1) Field of the Invention

The present invention pertains to a process for removing iron oxide scale from the surfaces of processed sheet metal. In particular, the present invention pertains to an apparatus and method of removing scale from the surfaces of processed sheet metal that employ high pressure jets of water directed from nozzles positioned in close proximity to the sheet metal surfaces.

(2) Description of the Related Art

Processed sheet metal is sheet metal that has been prepared for use in making cold rolled sheet metal, and for use in manufacturing some goods. Sheet metal of this type is used in the manufacturing of goods that require a thicker gauge steel, for example agricultural equipment, automotive parts, steel containers, bed frames, etc.

Before sheet metal is used by manufactures it is typically prepared by a hot rolling process. During the hot rolling process, carbon steel is heated to a temperature in excess of 1,500° F. (815° C.). The heated steel is passed through successive pairs of opposing rollers that reduce the thickness of the steel sheet. Once the hot rolling process is completed, the processed sheet metal or hot rolled steel is reduced to ambient temperature, typically by quenching it in water, oil, or a polymer liquid, all of which are well known in the art. The processed sheet metal is then coiled for convenient storage and transportation to the ultimate user of the processed sheet metal, i.e. the manufacture of aircraft, automobiles, or home appliances, etc.

During the cooling stage of processing the hot rolled sheet metal, reactions of the sheet metal with oxygen in the air and the moisture involved in the cooling process can result in the formation of an iron oxide layer, or scale as it is commonly referred to, on the surfaces of the sheet metal. The rate at which the sheet metal is cooled and the total temperature drop from the hot rolling process effects the amount and composition of scale that forms on the surface during the cooling process.

Before the sheet metal can be used by the manufacture, the surface of the sheet metal must be conditioned so that the sheet metal can be painted or otherwise coated, and the sheet metal provides a smooth exterior surface of the product being manufactured. The most common method of removing oxide from the surface of hot rolled or processed sheet metal before coating the sheet metal surfaces is a process known as "pickle and oil". In this process of removing oxide, the sheet metal, already cooled to ambient temperature following the hot rolling process, is uncoiled and pulled through a bath of hydrochloric acid to chemically remove the scale formed on the sheet metal surfaces. Following removal of the scale by the acid bath, the sheet metal is then washed, dried, and immediately "oiled" to protect the surfaces of the sheet metal from oxidation or rust. The oil provides a film layer barrier to air that shields the bare metal surfaces of the sheet metal from exposure to atmospheric air and moisture. It is critical that the sheet metal be oiled immediately after the pickling process, because the bare metal surfaces will begin to oxidize almost immediately when exposed to the atmospheric air and moisture.

The "pickle and oil" process is effective in removing substantially all of the oxide layer or scale from processed sheet metal. However, the "pickle and oil" process has a number of disadvantages. For example, the acid used in the acid bath of the sheet metal is an environmentally hazardous chemical which has special storage and disposal restrictions. In addition, the acid bath stage and subsequent oiling stage of the sheet metal "pickle and oil" process requires a substantial area in the manufacturing facility of the sheet metal.

Thus, there is a need in the industry for an improved apparatus and method for surface conditioning processed sheet metal by removing oxide or scale from the surfaces of the sheet metal that does not require the manufacturing floor space of the prior art "pickle and oil" process, and does not require the use of a hazardous chemicals such as in the "pickle and oil" process.

SUMMARY OF THE INVENTION

The present invention overcomes the disadvantages associated with the prior art apparatus and methods employed in removing scale from processed sheet metal by providing a less complex process for removing the scale that does not involve the use of hazardous chemicals. The apparatus of the invention receives previously processed, "i.e. hot rolled" sheet metal and performs the method of the invention to fully remove scale from the sheet metal surfaces.

The apparatus of the invention employs a leveler that receives a length of sheet metal from a coiled roll of processed sheet metal, and exerts bending forces against the opposite top and bottom surfaces of the sheet metal to substantially plane or level the length of sheet metal received from the roll.

The length of sheet metal travels from the leveler to a first brusher that has a plurality of opposed pairs of rotating brushes that receive the length of leveled sheet metal from the leveler. The rotating brushes impact against the opposite top and bottom surfaces of the length of sheet metal and provide initial removal of scale from the opposite surfaces of the sheet metal.

The length of leveled sheet metal is then received by a descaler of the apparatus. The descaler includes a plurality of high pressure water nozzles arranged in rows above and below the length of sheet metal passing through the descaler. The rows of nozzles are opposed by sheet metal supports that engage against the length of sheet metal directly opposite the rows of nozzles. The nozzles eject high pressure jets of water from close proximity to the opposite surfaces of the length of sheet metal, and thereby remove the scale from the surfaces of the sheet metal as the length of sheet metal passes through the descaler.

The apparatus also includes a second brusher that has a plurality of opposed pairs of rotating brushes that receive the length of sheet metal from the descaler. The rotating brushes impact against the opposite surfaces of the length of sheet metal and remove any residual scale remaining following the processing of the descaler. The rotating brushes impacting the opposite surfaces of the sheet metal also condition and further smooth the sheet metal surfaces.

The length of sheet metal then passes through a dryer that dries the water from the sheet metal.

The length of sheet metal is then transferred past an oxide detector that determines a level of scale, if any, still present on the length of sheet metal.

The dried length of sheet metal that passes through an oiler that immediately applies a film of oil to the dried surfaces of the sheet metal, thereby immediately preventing oxidation of the surfaces.

The dried and oiled length of sheet metal is then passed to a recoiler that coils the length of sheet metal back into a roll. The descaled and oiled roll of sheet metal is then ready for further processing by a manufacturer, or storage of the roll until needed.

The descaling apparatus and its method of operation provide a novel process of removing scale from processed sheet metal that does not require the manufacturing floor space of prior art processes, and does not require the use of dangerous chemicals.

BRIEF DESCRIPTION OF THE DRAWING

Further features of the apparatus and method of the invention are set forth in the following detailed description of the invention and in the drawing figure wherein.

DETAILED DESCRIPTION OF THE PREFERRED EMBODIMENT

Figure 1:
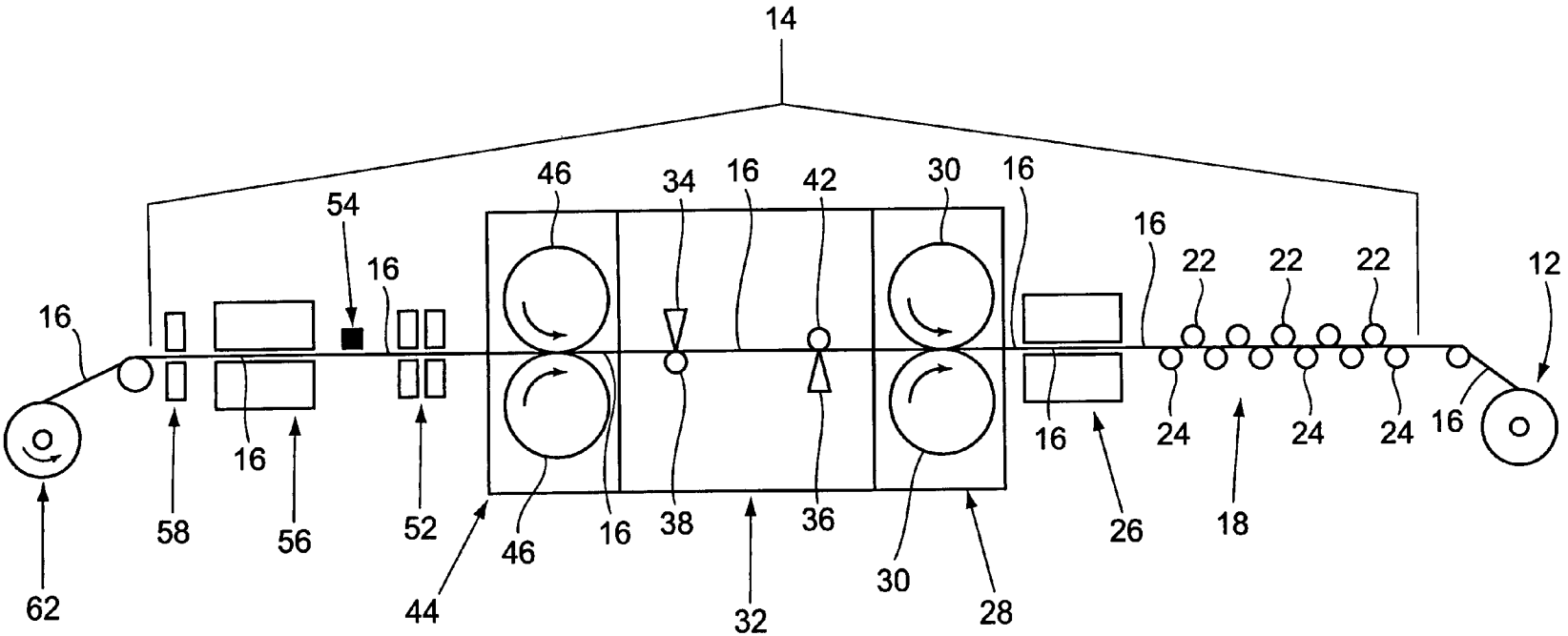
FIG. 1 is a schematic representation of the processed sheet metal descaling apparatus of the invention and its method of operation.

FIG. 1 shows a schematic representation of the apparatus of the invention that is used to perform the method of the invention in removing scale from the surfaces of processed sheet metal. As will be explained, the sheet metal moves from right to left through the apparatus shown in FIG. 1. The component parts of the apparatus to be described and shown in FIG. 1 are the preferred embodiment of the invention. It should be understood that variations and modifications could be made to the preferred embodiment to be described without departing from the intended scope of protection provided by the claims of the application.

Referring to FIG. 1, a roll of previously processed sheet metal (for example hot rolled sheet metal) 12 is positioned adjacent the apparatus 14 for supplying a length of sheet metal 16 to the apparatus. The roll of sheet metal 12 may be supported on any conventional device that functions to selectively uncoil the length of sheet metal 16 from the roll 12 in a controlled manner.

A leveler 18 of the apparatus 14 is positioned adjacent the sheet metal roll 12 to receive the length of sheet metal 16 uncoiled from the roll. The leveler 18 is comprised of a plurality of spaced rolls 22, 24. Several of the rolls 22 are positioned to engage the top surface of the length of sheet metal 16 as it passes through the leveler 18, and several of the rolls 24 are positioned to engage the bottom surface of the sheet metal. The alternating positioning of the rolls 22, 24 tends to bend the length of sheet metal in opposite directions as the sheet metal passes from right to left through the leveler. This working of the length of sheet metal 16 by the leveler 18 removes a substantial amount of the deformation of the sheet metal caused by being stored in the roll 12. This leveling of the length of sheet metal 16 is an important step in the process of the invention, which requires that the length of sheet metal be as flat as possible during the process. Although the a roller leveler is shown in the drawing figures, other types of levelers may be employed in the apparatus and process of the invention.

A first tensioner 26 is positioned adjacent the leveler 18 and receives the length of sheet metal 16 from the leveler. The tensioner 26 of the embodiment of the invention shown in FIG. 1 is a drag pad tensioner, known in the art. The tensioner 26 functions to exert a tensile force as the length of the sheet metal 16 passes through the tensioner from right to left as shown in FIG. 1 to further insure that the length of sheet metal 16 exiting the tensioner 26 presents substantially flat top and bottom surfaces.

A first brusher 28 is positioned adjacent the first tensioner 26 to receive the length of sheet metal 16 from the tensioner. The brusher 28 comprises pluralities of rotating brushes 30 arranged across the length of the sheet metal 16. The rotating brushes 30 contact the opposite top and bottom surfaces of the length of sheet metal 16 as the sheet metal passes through brusher 28, and provide an initial removal of scale from the opposite surfaces of the sheet metal. The brushes 30 act with non-pressurized water sprayed at the intersection of the brushes and the opposite surfaces of the sheet metal 16 to wash away the scale removed from the surfaces of the sheet metal. The leveling of the length of sheet metal 16 by the leveler 18 is an important step in the scale removal method of the apparatus in that it assures the optimal performance of the rotating brushes 30.

The descaler 32 is positioned adjacent the first brusher 28 to receive the length of sheet metal 16 from the brusher. The descaler 32 is comprised of pluralities of water nozzles 34, 36 that are arranged in rows across the length of sheet metal 16 passing through the descaler. Only two rows of nozzles 34, 36 are represented in FIG. 1. The descaler 32 could comprise several more rows of nozzles. However, at least one row of nozzles 34 extends across the top surface of the length of sheet metal 16 and at least one row of nozzles 36 extends across the bottom surface of the length of sheet metal 16. The nozzles 34, 36 are positioned in close proximity to the opposite surfaces of the length of sheet metal 16. The nozzles 34, 36 are positioned within 5 inches of the opposite top and bottom surfaces of the sheet metal 16, and are preferably positioned approximately 1 inch from the surfaces of the sheet metal. With this close positioning of the nozzles 34, 36 to the opposite surfaces of the length of sheet metal 16, the previously described leveling of the sheet metal by the leveler 18 is very important to the process of the invention. The nozzles 34, 36 are supplied with high pressure water and direct jets of water perpendicularly toward the opposite top and bottom surfaces of the length of sheet metal 16. In the preferred embodiment, the water jets ejected by the nozzles 34, 36 are at a pressure ranging from 40,000 psi to 60,000 psi, most preferably 30,000 psi. Also in the preferred embodiment, 100 grit garnet is mixed with the water ejected by the nozzles 34, 36. The garnet, or other equivalent particles, is mixed with the water in an amount to be used at a rate of 12 ounces per minute. Each of the nozzles 34, 36 ejects a water jet in a spray pattern that is approximately 1 inch wide. For a length of sheet metal having a width of 72 inches, there are 72 water jet nozzles in each row spatially arranged across the width of the length of sheet metal 16 passing through the descaler.

Each row of nozzles 34, 36 is opposed by a sheet metal support 38, 42 that is positioned on an opposite side of the length of sheet metal 16 from the nozzles 34, 36. The supports 38, 42 can be a row of rollers or other similar types of supports that engage the surfaces of the length of sheet metal 16 directly opposite the rows of nozzles 34, 36. The supports 38, 42 maintain the desired positioning of the opposite surfaces of the length of sheet metal 16 relative to the nozzles 34, 36.

A second brusher 44 is positioned adjacent the descaler 32 to receive the length of sheet metal 16 from the descaler. The brusher 44 comprises pluralities of rotating brushes 46 arranged across the length of sheet metal 16. The rotating brushes 46 contact the opposite top and bottom surfaces of the length of sheet metal 16 as the sheet metal passes through the brusher 44, and remove any residual scale. The brushes 46 act with non-pressurized water sprayed at the intersection of the brushes and the opposite surfaces of the length of sheet metal 16 to eliminate the scale from the material. The brushes 46 also condition and smooth the opposite surfaces of the length of sheet metal 16, eliminating any roughness in the surfaces created by the water jets of the descaler 32. The leveling of the length of sheet metal 16 by the leveler 18 is also needed for the desired functioning of the brusher 44.

A dryer 52 is positioned adjacent the second brusher 44 to receive the length of sheet metal 16 from the second brusher. The dryer 52 dries the water from the surfaces of the length of sheet metal 16 as the sheet metal passes through the dryer.

An oxide detector 54 is positioned adjacent the dryer 52 to receive the length of sheet metal 16 exiting the dryer. The oxide detector 54 shown in FIG. 1 is positioned adjacent only the top surface of the length of sheet metal 16. A second oxide detector could be positioned adjacent the bottom surface of the length of sheet metal 16. The oxide detector 54 is connected to a computerized control system (not shown) of the apparatus and enables real time monitoring of the scale removed by the apparatus 14 to enable substantially instant adjustment of the apparatus to achieve full scale removal.

A second tensioner 56 is positioned adjacent the oxide detector 54 to receive the length of sheet metal 16 from the detector. The second tensioner 56 is substantially the same in construction as the first tensioner 26, i.e. a drag pad tensioner. The tensioner 56 exerts a tensile force on the length of sheet metal 16 as the sheet metal exits the tensioner.

An oiler 58 is positioned adjacent the second tensioner 56 to receive the length of sheet metal 16 from the tensioner. The oiler 58 applies oil to the surfaces of the length of sheet metal 16 as the sheet metal passes through the oiler. The film of oil applied to the length of sheet metal 16 protects the sheet metal from scale formation.

A coiler receives the length of sheet metal 16 from the oiler 58 and rolls the length of sheet metal into a coil 62 for storage or transportation of the sheet metal.

The apparatus 14 described above provides a means of substantially removing all scale from processed sheet metal (i.e., sheet metal that has been previously hot rolled or otherwise processed) that requires less manufacturing floor space and less expense than prior art descaling processes, for example pickling. Summarizing the basic process of the invention, the length of processed sheet metal is first leveled by subjecting the opposite top and bottom surfaces of the sheet metal to bending forces that plane the length of sheet metal with the top and bottom surfaces of the length of sheet metal being substantially flat.

The length of sheet metal is then descaled by subjecting the opposite top and bottom surfaces of the length of sheet metal to jets of high pressure water that remove scale from the opposite top and bottom surfaces of the length of sheet metal.

The water remaining on the length of the sheet metal is then dried from the opposite top and bottom surfaces. The opposite top and bottom surfaces of the length of sheet metal are then subjected to a film of oil after drying. The descaled sheet metal is then coiled into a roll for storage or transportation of the sheet metal.

Additional features of the method of the invention include brushing the opposite top and bottom surfaces before and after the water jet descaling process. The brushing provides initial scale removal, and further removes residual scale from the opposite top and bottom surfaces of the length of sheet metal, and conditions the surfaces by smoothing any roughness resulting from the water jet descaling.

The process of the invention is estimated as having the benefits of only 20% of the variable costs involved in the prior art descaling method of pickling, and 20% of the capital costs of the pickling. The process of the invention has the further benefit of being completely environmentally friendly, without requiring the dangerous chemicals of the prior art pickling process. The apparatus and the method of the invention also require only about 100 feet of line floor space, versus 500 feet of line floor space typically required for a pickling process.

Although the apparatus and the method of the invention have been described herein by referring to a preferred embodiment of the invention, it should be understood that variations and modifications could be made to the basic concept of the invention without departing from the intended scope of the following claims.

What is claimed is:

1. An apparatus that removes scale from sheet metal, the apparatus comprising:

a leveler that receives a length of sheet metal and subjects opposite top and bottom surfaces of the length of sheet metal to forces that plane the length of sheet metal with the opposite top and bottom surfaces of the length of sheet metal being substantially flat;

a descaler that receives the length of sheet metal from the leveler and subjects the opposite top and bottom surfaces of the length of sheet metal to jets of high pressure water that remove scale from the opposite top and bottom surfaces of the length of sheet metal;

a dryer that receives the length of sheet metal from the descaler and dries water from the opposite top and bottom surfaces of the length of sheet metal;

an oiler that receives the length of sheet metal from the dryer and subjects the opposite top and bottom surfaces of the length of sheet metal to a film of oil; and, an oxide detector positioned adjacent the dryer that receives the length of sheet metal from the dryer and senses oxide scale present on the length of sheet metal.

2. The apparatus of claim 1, further comprising:

a tensioner positioned between the leveler and the descaler that receives the length of sheet metal from the leveler and subjects the length of sheet metal to a tensile force prior to the length of sheet metal being received by the descaler.

3. The apparatus of claim 2, further comprising:

a brusher positioned between the descaler and the oxide detector to receive the length of sheet metal from the descaler and subject the opposite top and bottom surfaces of the length of sheet metal to brushing forces that remove residual scale.

4. The apparatus of claim 3, further comprising:

a second tensioner positioned between the dryer and the oiler to receive the length of sheet metal from the dryer and subject the length of sheet metal to a tensile force prior to the length of sheet metal being received by the dryer.

5. An apparatus that removes scale from sheet metal, the apparatus comprising:

a leveler that receives a length of sheet metal and subjects opposite top and bottom surfaces of the length of sheet metal to forces that plane the length of sheet metal with the opposite top and bottom surfaces of the length of sheet metal being substantially flat;

a descaler that receives the length of sheet metal from the leveler and subjects the opposite top and bottom surfaces of the length of sheet metal to jets of high pressure water that remove scale from the opposite top and bottom surfaces of the length of sheet metal;

a dryer that receives the length of sheet metal from the descaler and dries water from the opposite top and bottom surfaces of the length of sheet metal;

an oiler that receives the length of sheet metal from the dryer and subjects the opposite top and bottom surfaces of the length of sheet metal to a film of oil; and, the descaler having a plurality of water nozzles arranged in a row that extends across the length of sheet metal on one side of the sheet metal, and a sheet metal support engaging an opposite side of the length of sheet metal directly opposite the plurality of water nozzles.

6. The apparatus of claim 5, further comprising:

the plurality of water nozzles ejecting jets of water against the top and bottom surfaces of the length of sheet metal at a pressure ranging from 40,000 psi to 60,000 psi.

7. The apparatus of claim 5, further comprising:

the plurality of water nozzles being positioned substantially within 5 inches of the top and bottom surfaces of the length of sheet metal.

8. The apparatus of claim 5, further comprising:

an uncoiler supporting a roll of processed sheet metal adjacent the leveler, the uncoiler being operative to uncoil the length of sheet metal from the roll with the leveler receiving the length of sheet metal from the uncoiler.

9. An apparatus that removes scale from sheet metal, the apparatus comprising:

a leveler that receives a length of sheet metal and subjects opposite top and bottom surfaces of the length of sheet metal to forces that plane the length of sheet metal with the opposite top and bottom surfaces of the length of sheet metal being substantially flat;

a descaler that receives the length of sheet metal from the leveler and subjects the opposite top and bottom surfaces of the length of sheet metal to jets of high pressure water that remove scale from the opposite top and bottom surfaces of the length of sheet metal;

a dryer that receives the length of sheet metal from the descaler and dries water from the opposite top and bottom surfaces of the length of sheet metal;

an oiler that receives the length of sheet metal from the dryer and subjects the opposite top and bottom surfaces of the length of sheet metal to a film of oil; and, the descaler having a plurality of water nozzles arranged across the top and bottom surfaces of the length of sheet metal and a plurality of sheet supports arranged across and engaging the top and bottom surfaces of the length of sheet metal, each sheet support being positioned directly opposite at least one of the plurality of water nozzles on opposite sides of the length of sheet metal.

10. An apparatus that removes scale from sheet metal, the apparatus comprising:

a descaler that receives the length of sheet metal and subjects opposite top and bottom surfaces of the length of sheet metal to jets of high pressure water that remove scale from the top and bottom surfaces of the length of sheet metal;

a brusher positioned adjacent the descaler that receives the length of sheet metal from the descaler and brushes the top and bottom surfaces of the length of sheet metal to remove residual scale;

an oiler that receives the length of sheet metal from the brusher and applies oil to the top and bottom surfaces of the length of sheet metal coating the length of sheet metal in a film of oil; and, an oxide detector positioned between the brusher and the oiler and that receives the length of sheet metal from the brusher and senses oxide scale present on the length of sheet metal.

11. The apparatus of claim 10, further comprising:

a dryer positioned before the oxide detector that receives the length of sheet metal before the oxide detector and dries water from the top and bottom surfaces of the length of sheet metal.

12. The apparatus of claim 11, further comprising:

a leveler that receives the length of sheet metal and subjects the top and bottom surfaces of the length of sheet metal to bending forces that plane the length of sheet metal prior to the length of sheet metal being received by the descaler.

13. The apparatus of claim 12, further comprising:

a first tensioner positioned between the leveler and the descaler that receives the length of sheet metal from the leveler and subjects the length of sheet metal to a tensile force prior to the length of sheet metal being received by the descaler.

14. The apparatus of claim 13, further comprising:

a second tensioner positioned between the dryer and the oiler to receive the length of sheet metal from the dryer and subject the length of sheet metal to a tensile force prior to the length of sheet metal being received by the dryer.

15. An apparatus that removes scale from sheet metal, the apparatus comprising:

a descaler that receives the length of sheet metal and subjects opposite top and bottom surfaces of the length of sheet metal to jets of high pressure water that remove scale from the top and bottom surfaces of the length of sheet metal;

a brusher positioned adjacent the descaler that receives the length of sheet metal from the descaler and brushes the top and bottom surfaces of the length of sheet metal to remove residual scale; and, the descaler having a plurality of water nozzles arranged in a row that extends across the length of sheet metal on one side of the length of sheet metal, and a sheet metal support engaging an opposite side of the length of sheet metal directly opposite the plurality of water nozzles.

16. The apparatus of claim 15, further comprising:

the plurality of water nozzles ejecting jets of water against the top and bottom surfaces of the length of sheet metal at a pressure ranging from 40,000 psi to 60,000 psi.

17. The apparatus of claim 15, further comprising:

the plurality of water nozzles being positioned substantially within 5 inches of the top and bottom surfaces of the length of sheet metal.

18. The apparatus of claim 15, further comprising:

an uncoiler supporting a roll of processed sheet metal adjacent the leveler, the uncoiler being operative to uncoil the length of sheet metal from the roll with the leveler receiving the length of sheet metal from the uncoiler.

19. An apparatus that removes scale from sheet metal, the apparatus comprising:

a descaler that receives the length of sheet metal and subjects opposite top and bottom surfaces of the length of sheet metal to jets of high pressure water that remove scale from the top and bottom surfaces of the length of sheet metal;

a brusher positioned adjacent the descaler that receives the length of sheet metal from the descaler and brushes the top and bottom surfaces of the length of sheet metal to remove residual scale; and, the descaler having a plurality of water nozzles arranged across the top and bottom surfaces of the length of sheet metal and a plurality of sheet supports arranged across and engaging the top and bottom surfaces of length of sheet metal, each sheet support being positioned directly opposite at least one of the plurality of water nozzles on opposite sides of the length of sheet metal.

20. A method of removing scale from sheet metal comprising:

leveling a length of sheet metal by subjecting opposite top and bottom surfaces of the length of sheet metal to bending forces that plane the length of sheet metal with the top and bottom surfaces of the length of sheet metal being substantially flat;

descaling the length of sheet metal after the leveling by subjecting the opposite top and bottom surfaces of the length of sheet metal to jets of high pressure water that remove scale from the opposite top and bottom surfaces of the length of sheet metal;

drying water from the top and bottom surfaces of the length of sheet metal after the scale has been removed;

subjecting the top and bottom surfaces of the length of the sheet metal to a film of oil after drying the length of sheet metal; and, sensing oxide scale on the length of sheet metal after descaling the length of sheet metal.

21. The method of claim 20, further comprising:

brushing the top and bottom surfaces of the length of sheet metal after descaling the length of sheet metal and prior to drying the length of sheet metal to remove residual scale from the length of sheet metal.

22. The method of claim 21, further comprising:

subjecting the length of sheet metal to a tensile force after leveling the length of sheet metal and prior to descaling the length of sheet metal.

23. The method of claim 20, further comprising:

subjecting the top and bottom surfaces of the length of sheet metal to jets of water at a pressure ranging from 40,000 psi to 60,000 psi.

24. The method of claim 20, further comprising:

subjecting the opposite to and bottom surfaces of the length of sheet metal to jets of high pressure water from water nozzles positioned substantially within 5 inches of the length of sheet metal.

25. The method of claim 24, further comprising:

subjecting the top and bottom surfaces of the length of sheet metal to jets at a pressure ranging from 40,000 psi to 60,000 psi.

26. A method of removing scale from sheet metal comprising:

leveling a length of sheet metal by subjecting opposite top and bottom surfaces of the length of sheet metal to bending forces that plane the length of sheet metal with the top and bottom surfaces of the length of sheet metal being substantially flat;

descaling the length of sheet metal after the leveling by subjecting the opposite top and bottom surfaces of the length of sheet metal to jets of high pressure water that remove scale from the opposite top and bottom surfaces of the length of sheet metal;

drying water from the top and bottom surfaces of the length of sheet metal after the scale has been removed;

subjecting the top and bottom surfaces of the length of the sheet metal to a film of oil after drying the length of sheet metal; and, subjecting the opposite top and bottom surfaces of the length of sheet metal to high pressure water jets while engaging sheet supports against the length of sheet metal directly opposite the high pressure water jets.

* * * * *